US006085450A

United States Patent [19]

Ruck

[11] Patent Number: 6,085,450

[45] Date of Patent: Jul. 11, 2000

[54] ANIMATED DISPLAY MECHANISM AND ANIMATED DISPLAY

[75] Inventor: George W. Ruck, Bethel Park, Pa.

[73] Assignee: Ruck Engineering, Inc., Bethel Park, Pa.

[21] Appl. No.: 09/052,642

[22] Filed: Mar. 31, 1998

[51] Int. Cl.[7] ..... G09F 19/08

[52] U.S. Cl. ..... 40/415; 74/55

[58] Field of Search ..... 40/415; 74/54, 74/55; 273/317.2, 108.22

[56] References Cited

U.S. PATENT DOCUMENTS

| | | | |
|---|---|---|---|
| 168,245 | 9/1875 | Ferguson et al. | 74/55 |
| 261,145 | 7/1882 | Ethridge et al. | 74/55 X |
| 1,297,156 | 3/1919 | Harris, Jr. | 74/55 |
| 1,825,778 | 10/1931 | Chester . | |
| 2,183,950 | 12/1939 | Ackerman | 74/55 X |
| 2,407,859 | 9/1946 | Wilson | 74/55 |
| 2,528,386 | 10/1950 | Napper | 74/55 |
| 2,567,735 | 9/1951 | Scott | 74/55 X |
| 3,050,307 | 8/1962 | Glass et al. . | |
| 3,288,467 | 11/1966 | Rudolph . | |
| 3,458,195 | 7/1969 | Neubeck . | |
| 3,809,404 | 5/1974 | Fikse . | |
| 4,058,313 | 11/1977 | Spradlin . | |
| 4,130,280 | 12/1978 | Lowell . | |
| 4,177,592 | 12/1979 | Ruck | 40/426 |
| 4,202,545 | 5/1980 | Watanabe . | |
| 4,591,158 | 5/1986 | Samson et al. . | |
| 5,297,448 | 3/1994 | Galvin | 74/55 |
| 5,393,058 | 2/1995 | Rowland et al. . | |

*Primary Examiner*—Joanne Silbermann
*Attorney, Agent, or Firm*—Andrew J. Cornelius

[57] ABSTRACT

An animated display mechanism provides two components of motion to an object. The mechanism includes a mechanism base, a slide plate to which both a motor and the object are mounted, and a cam that is mounted to and rotated by the motor shaft. An animated golfer display employs the display mechanism, and repeatedly executes an animation cycle, during which a golfer advances toward a golf ball on a putting green, stops, takes two practice puts, approaches the golf ball, and putts the ball into the cup. The ball is returned to the green by the display mechanism as the golfer retreats to a position in which the animation cycle can repeat.

20 Claims, 9 Drawing Sheets

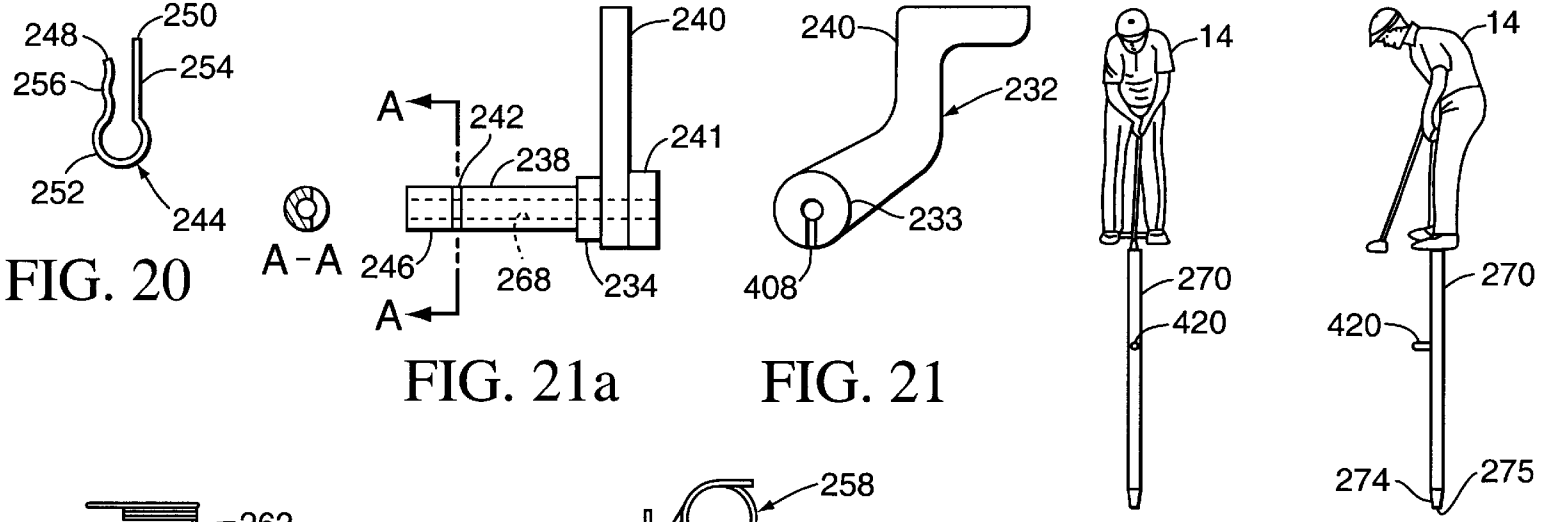
FIG. 23
FIG. 23a
FIG. 21
FIG. 21a
FIG. 20
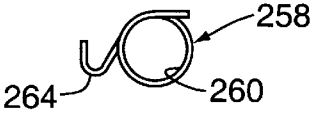
FIG. 22
FIG. 22a
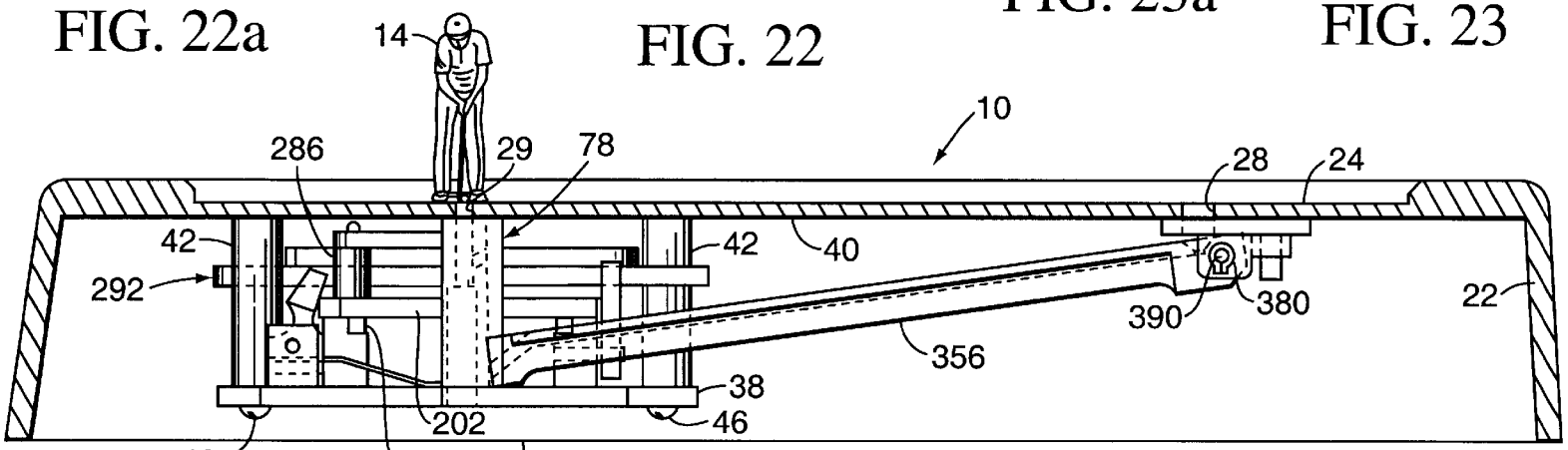
FIG. 2

ANIMATED DISPLAY MECHANISM AND ANIMATED DISPLAY

BACKGROUND OF THE INVENTION

Animated displays that move one or more figures to create a scene are well known. They are, however, usually either limited, in that only simple motion is provided, or their animation mechanisms are very complicated if complex motion is provided. There is, therefore, a need for an animated display that provides complex motion using relatively simple mechanisms.

SUMMARY OF THE INVENTION

The present invention provides an animation mechanism that exhibits two elements or components of motion, and a display that uses the animation mechanism. For example, the preferred embodiments provided by the present invention are an animation mechanism that is used in a display that creates a scene in which a golfer approaches and putts a ball, and a display that incorporates the mechanism.

The golfer is given two components or elements of motion by the display—linear and rotational. The rotational motion allows the golfer to "putt" a golf ball. The linear motion allows the golfer also to approach and retreat from the spot from which the ball is putted, which provides a significantly improved golf scene.

Normally, either a very complicated mechanism would need to be used to provide this complex motion, or one of the components or elements would need to be eliminated, resulting in a golfer that either putts a ball, or approaches and retreats from the ball, but not both. Using the present invention, a relatively simple mechanism can provide both elements of motion. In the preferred embodiment of the present invention, this simplicity results from mounting the electric motor in such a way that it moves with the golfer as the golfer approaches and retreats from the spot at which the ball is putted; specifically, the motor is mounted for movement with the golfer.

Accordingly, the present invention provides a mechanism for providing motion to an object associated with an animated display, including a support, a slide mounted to the support for movement relative thereto, a source of motion mounted to the slide, a translator that converts the motion produced by the motion source to movement of the slide. The present invention also provides a display incorporating the mechanism.

Additionally, the present invention provides an animated display in which an animated object exhibits both linear motion and rotational motion, and an animated golfer display including apparatus that causes a golfer figure repeatedly to approach and retreat from a fixed spot, and that causes the golfer to rotate to strike a ball located at the spot with a simulated golf club.

BRIEF DESCRIPTION OF THE DRAWING

The following detailed description of the preferred embodiment may be understood better if reference is made to the appended drawing, in which:

FIG. 2 is a sectional side view of the animated display shown in FIG. 1, which also shows the animated display mechanism provided by the present invention;

FIG. 20 is a plan view of the spring clip of the golfer assembly of the display mechanism shown in FIG. 2;

FIG. 21 is a top view of the golfer actuator of the display mechanism shown in FIG. 2;

FIG. 21A is a side view of the actuator shown in FIG. 21;

FIG. 22 is a plan view of the torsion spring for the actuator shown in FIG. 21;

FIG. 22A is a side view of the torsion spring shown in FIG. 22;

FIG. 23 is a front view of the golfer assembly of the display mechanism shown in FIG. 2:

FIG. 23A is a side view of the golfer assembly shown in FIG. 23;

DETAILED DESCRIPTION OF THE PREFERRED EMBODIMENT

Figures 1, 1A:
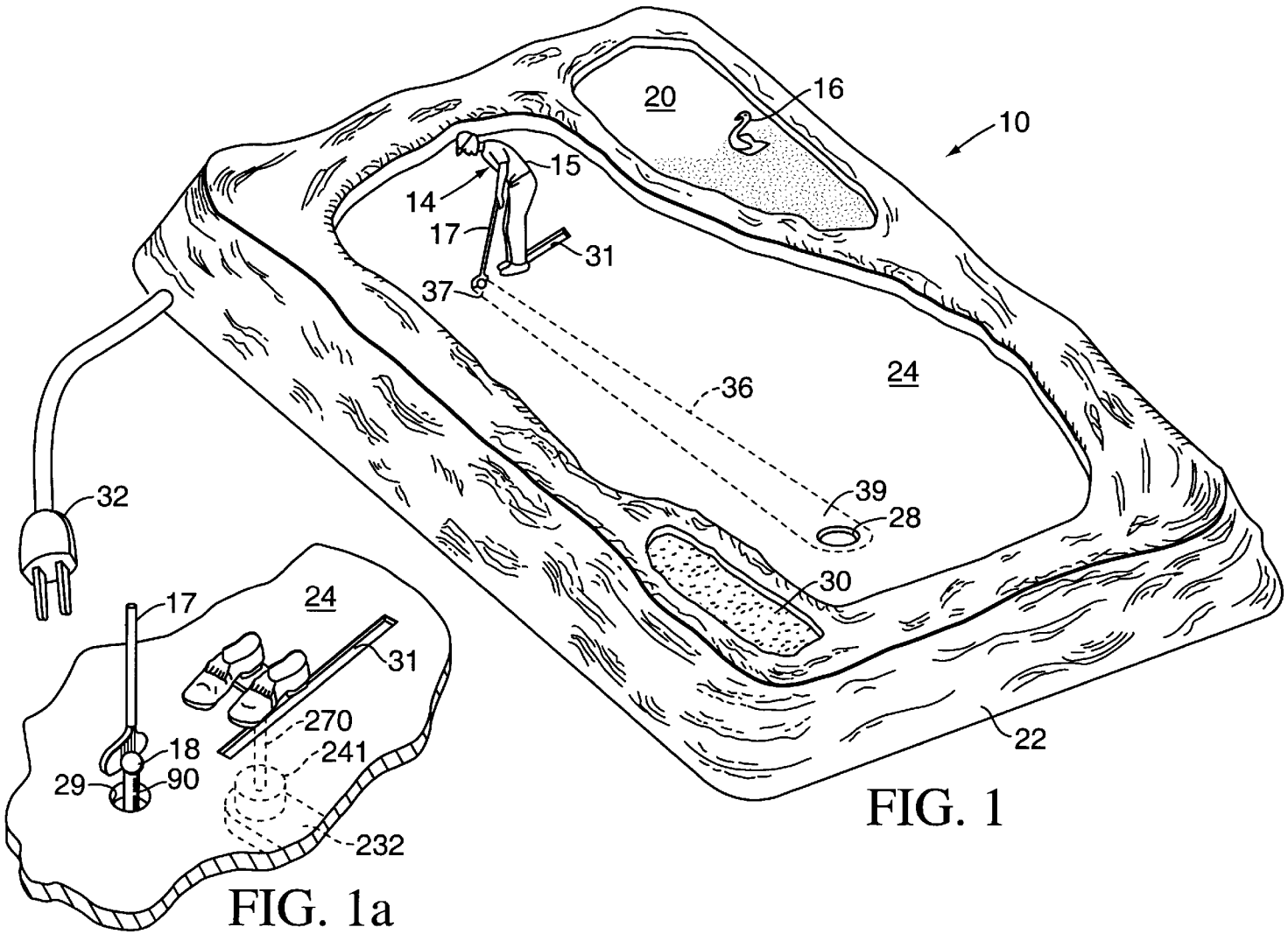
FIG. 1 is a perspective view of an animated display provided by the present invention.
FIG. 1A is a detail view of part of the golf ball and parts of the tee pin, golf figure and golfer post shown in FIG. 1.
Figure 3:
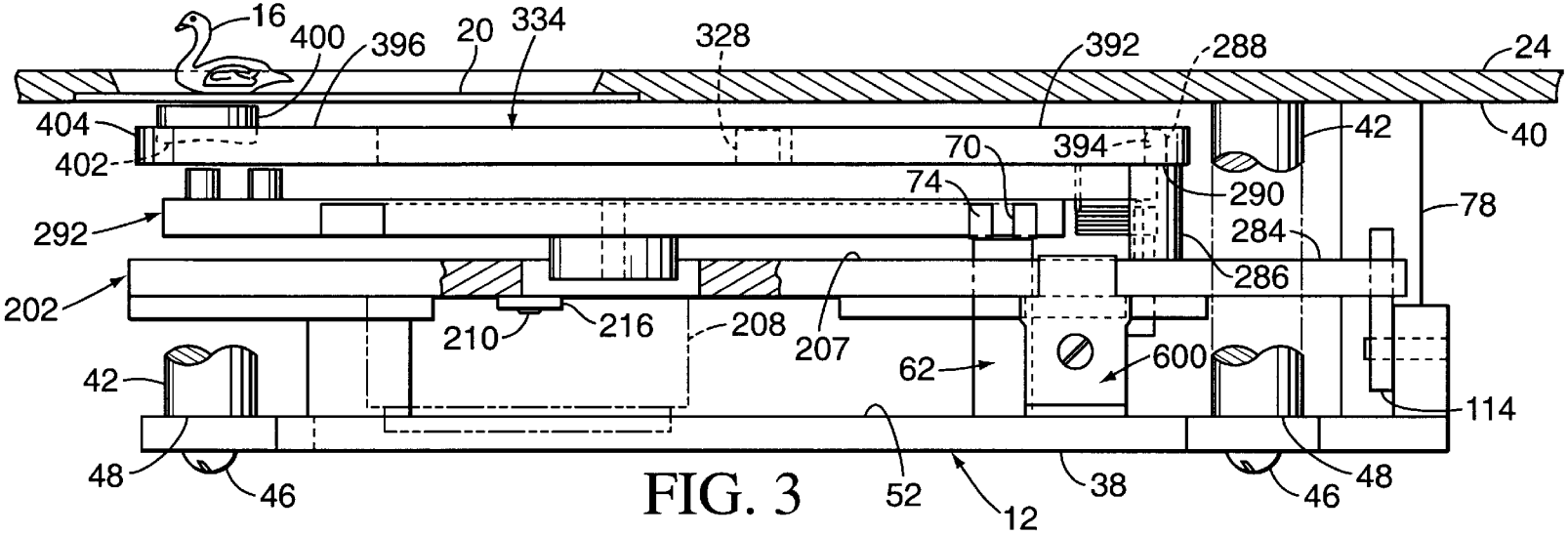
FIG. 3 is a right side view of the display mechanism shown in FIG. 2.
Figure 4:
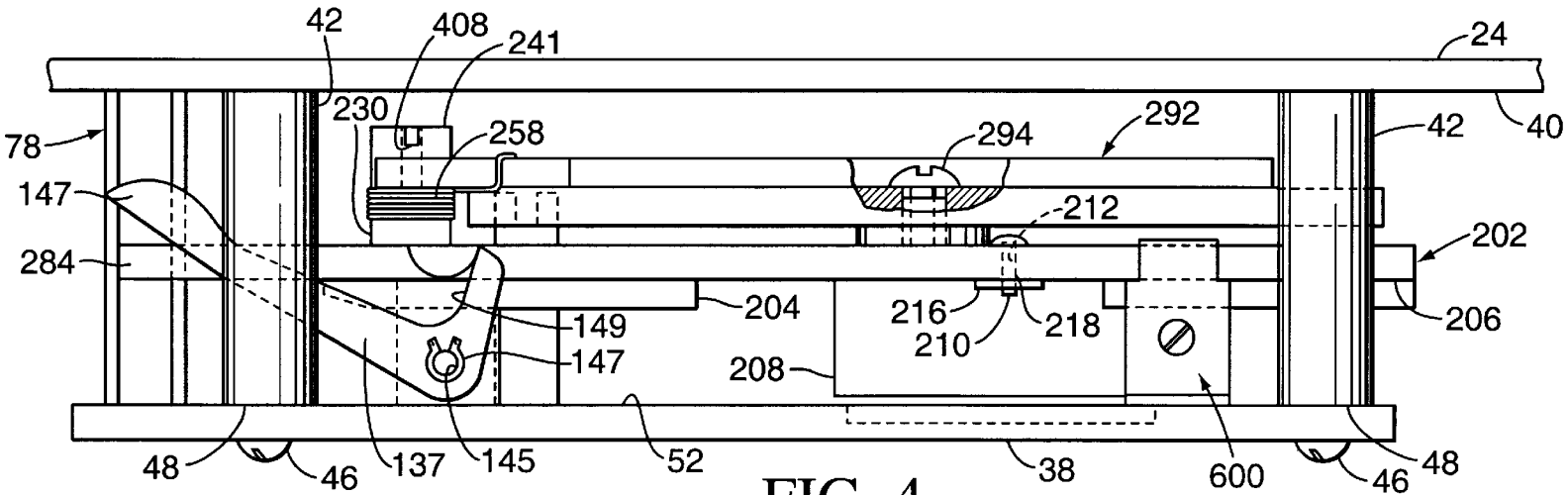
FIG. 4 is a left side view of the display mechanism shown in FIG. 2.
Figure 5:
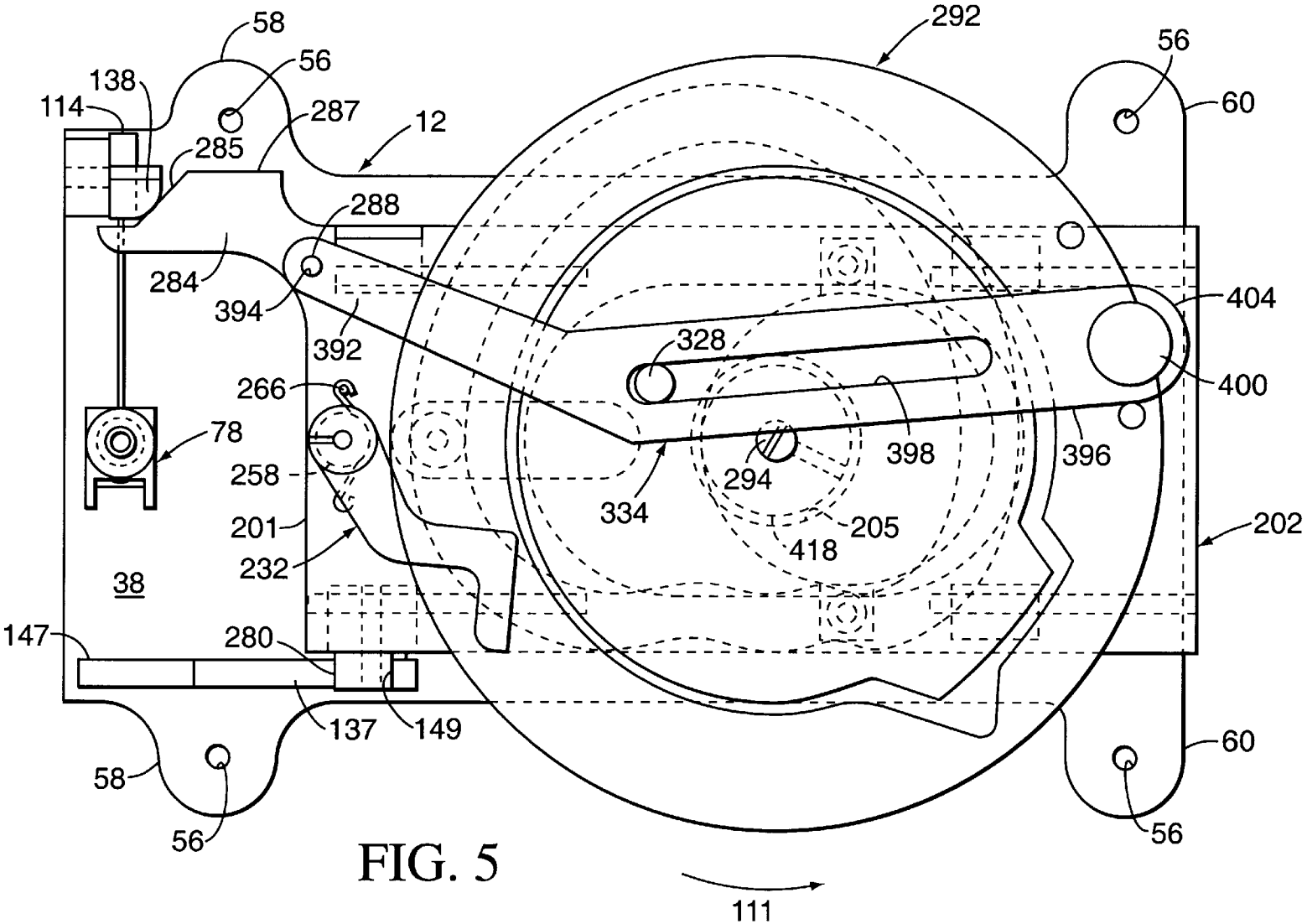
FIG. 5 is a top view of the display mechanism shown in FIG. 2.
Figure 18A:
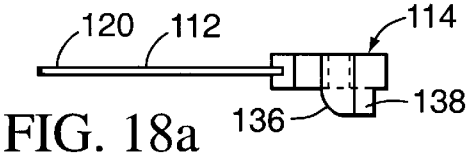
FIG. 18A is a top view of the actuator shown in FIG. 18
Figure 18:
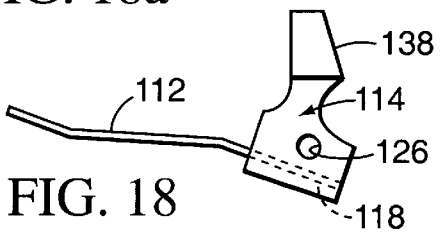
FIG. 18 is a side view of the tee pin actuator of the display mechanism shown in FIG. 2.
Figure 14C:
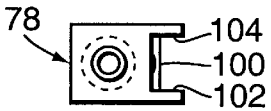
FIG. 14C is a top view of the ejector post shown in FIG. 14.

FIG. 1 of the drawing shows an animated display 10 that incorporates a display mechanism 12 (see FIGS. 2, 3, 4, and 5) that provides the motion for display 10, both of which are provided by the present invention. While display 10 shows a golf scene, the present invention can provide displays showing a variety of animated scenes.

Figure 15:
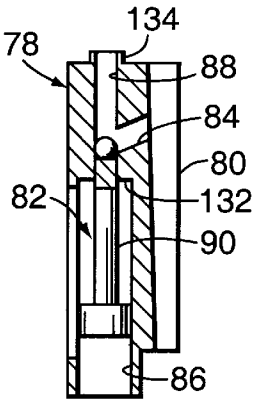
FIG. 15 is a side sectional view of the ball return assembly of the display mechanism shown in FIG. 2, with the golf ball in place in the depression on the tee pin of the ball return assembly.
Figure 6:
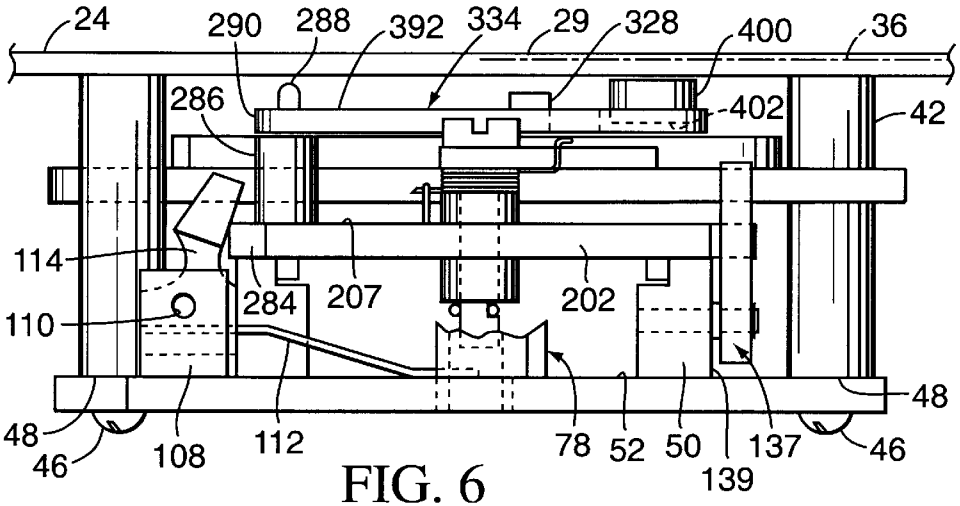
FIG. 6 is an end view of the display mechanism shown in FIG. 2.

Display 10 shows an animated golfer assembly 14, which consists of a golfer FIG. 15 with a golf club 17 and a golfer post 270, in the act of putting a golf ball 18, with an animated swan or duck 16 swimming in the background on a pond 20. Mechanism 12 moves swan 16 in an irregular, repeating path. Mechanism 12 also causes golfer 14, starting in an initial position at a distance from ball 18, to move toward ball 18, stop a short distance away from ball 18, oscillate twice in a circular arc to simulate taking two "practice swings," approach ball 18, and again oscillate once to strike ball 18 causing it to roll into hole 28 within a trough 36. Mechanism 12 then causes golfer 14 to retreat to the initial position, and, after a predetermined pause, repeats the cycle until display 10 is turned off.

The components of display 10 can be formed from any suitable plastic or metal as desired. Display 10 includes a raised base 22 that simulates part of a fairway and a golf green 24 that defines a slot 31, and that includes an ornamental sand trap 30. Golf green 24 defines a hole 28 that simulates the golf hole or cup, and a hole 29, which provides passage for movable tee pin 90 to raise ball 18 slightly above the plane of green 24 and into position for putting. FIG. 1A is an enlarged detail view showing, among other components, tee pin 90 and ball 18 on pin 90. For clarity, tee pin 90 is shown in FIG. 1A extending farther above green 24 than is preferable. Tee pin 90 should be sized and mounted to ensure that ball 18 is not so far above green 24 that it escapes from trough 36 after it is stroked by golfer 14. Preferably, the top of tee pin 90 extends only slightly above green 24. Green 24 is at a 2.86 degree angle to the horizontal. The golfer 14 putts ball 18, and ball 18 rolls toward and into hole 28. Ball 18 is guided into hole 28 by a trough 36 formed in green 24, within which ball 18 rolls. Trough 36 consists of a slight recess in green 24 and extends between tee 90 and hole 28. The depth of trough 36 deepens uniformly from 0.055 inches at end 37, which is near golfer 14, to 0.100 inches at end 39, which terminates at hole 28. The variation in the depth of trough 36 and the inclination of green 24 to the horizontal permit gravity to cause ball 18 to roll to hole 28 when it is in trough 36. Slot 31 permits golfer post 270 to move toward and away from tee pin 90 located within hole 29 as golfer assembly 14 approaches and retreats from pin 90. Electrical connector and cord 32 provide electricity to electric motor 208 of mechanism 12 from any standard 120 volt electrical source. Motors of various voltages can be used with matching voltage supplies. Base 22 cooperates with the surface on which display 10 rests to enclose display mechanism 12. Mechanism 12 imparts two elements of motion to golfer 14. First, mechanism 12 provides linear motion to golfer 14 to move golfer 14 to and away from tee pin 90 within hole 29. Second, mechanism 12 oscillates golfer 14 through a small arc to enable golfer FIG. 15 to simulate taking two practice swings and "putting" ball 18 with golf club 17.

Generally, display mechanism 12 includes:

1. A mechanism base 38 that is mounted to and stationary with respect to base 22, and components mounted to mechanism base 38;
2. A slide or shuttle plate 202 that moves linearly relative to base 22 and mechanism base 38 to which golfer 14 is mounted and, accordingly, which conveys the linear element of motion to golfer 14, and components mounted to plate 202;
3. An electric motor 208 that is mounted to shuttle plate 202, which provides the motion for display 10;
4. A cam 292, which converts the motion produced by motor 208 to the linear and oscillatory motion required by golfer 14;
5. A ball return assembly 78 that houses tee pin 90, on which ball 18 rests as it is being raised to its initial position in which it will be putted;
6. A tee pin actuator 114, which raises tee pin 90 to move ball 18 to its initial position through hole 29 formed in green 24 of base 22;
7. A ball return arm 356 that is raised and lowered by a lever 137 to receive ball 18 after it is putted through hole 28, and to return ball 18 from hole 28 to ball return assembly 78, which returns it to its initial position from which golfer 14 putts it; and
8. A magnet arm 334 that cooperates with cam 292 to move swan 16 along pond 20.

Display 10 executes an animation cycle that begins in an initial position in which golfer 14 is at its maximum distance from hole 29. As display 10 begins to execute the animation cycle, it causes golfer 14 to move toward hole 29 as ball return assembly 78 is raising tee pin 90 and ball 18. Ball 18 emerges through hole 29 and, a short time later, golfer 14 advances toward ball 18, but stops before it reaches ball 18 to take two practice swings. After the second practice swing, golfer 14 approaches ball 18 and stops at a position in which golfer 14 can strike ball 18 with golf club 17 when golfer 14 is oscillated. Golfer 14 strokes or putts ball 18, causing it to roll within trough 36 formed in green 24 toward hole 28. Trough 36 directs ball 18 to hole 28, and ball 18 falls through hole 28, where it is delivered to ball return arm 356. Ball return arm 356 directs ball 18 to ball return assembly 78, which, in turn, raises ball 18 through hole 29 to its initial position. As ball 18 is putted and is being delivered to ball return assembly 78 through hole 28, mechanism 12 begins to move golfer 14 away from hole 29 until golfer 14 reaches its initial position to begin another animation cycle.

Accordingly, golfer 14 must execute two types of motion. First, it must move linearly toward and away from tee pin 90. Second, it must oscillate through an arc to "practice" its putt, and to "putt" ball 18. Normally, either two separate electric motors would need to be provided to produce the two types of motion in golfer 14, or one motor would be used with two separate "linkages" or connections to golfer 14 to convert the motion produced by the single motor to the two elements of motion and to transfer those elements of motion to the golfer. In either case, the connections would be complicated. In display 10 the mechanism needed to provide the two required types of motion for golfer 14 has been simplified by mounting motor 208 used by display 10 on shuttle plate 202, to which golfer 14 also is mounted. In essence, because motor 208 is stationery with respect to the linear motion of golfer 14, and the apparatus to which it is mounted, a conventional cam and follower can be used to oscillate golfer 14 to practice its putt, and to putt ball 18. This simple arrangement would not be possible if motor 208 were to be mounted to the base and, thus, golfer 14 were to move relative to motor 208 during operation of display 10. During the animation cycle, a magnet arm 334, which is pivoted on slide plate 202 and is actuated by cam 292 just below green 24, causes swan 16 to "swim" along an irregular, repeating path on pond 20.

Mechanism 12 is mounted to four cylindrical posts 42 (two shown in FIG. 3 and two shown in FIG. 4) located on undersurface 40 of base 22. Mechanism base 38 is mounted to ends 48 of posts 42 using four screws 46 threaded through four holes 56 formed in mounting extensions 58 and 60 defined by mechanism base 38. Base 38 includes four bearing posts 50, 51, 53 and 55 on upper surface 52 of plate 38. Each bearing post 50, 51, 53 and 55 defines a notch 54 on its inboard edge, along which shuttle plate 202 slides during operation of display 10.

A roller post assembly 62 is located on upper surface 52 of mechanism base 38. Roller post assembly 62 includes a tapered roller post 66 that is incorporated on plate 38, a roller bearing 74 and a pivot pin 70. Pivot pin 70 is forced into a suitably sized passage 67 formed in end 72 of post 66 to provide a friction fit between pin 70 and the walls of passage 67. Pivot pin 70 extends from passage 67 a distance that is equal to the height of cylindrical roller bearing 74. Cylindrical roller bearing 74 defines a central opening 76 that is sized to receive pin 70. Accordingly, bearing 74 is mounted onto pivot pin 70 located in end 72 by inserting pin 70 through opening 76, and bearing 74 is free to rotate around pin 70. The oblong hole 68 formed in base 38 provides clearance for that part of motor 208 housing that projects down into mechanism base 38.

Ball return assembly 78 is located on upper surface 52 of mechanism base 38. Assembly 78 includes ejector post 80, which is located on upper surface 52 of plate 38, and a tee pin 90, which is located within tee pin passage 82 formed in post 80. Ball return arm 356 returns ball 18 to tee pin 90 in assembly 78 after ball 18 drops through hole 28 in green 24, and tee pin actuator 114 raises tee pin 90 until ball 18 passes through hole 29 in green 24, and is in its initial position in the animation cycle on tee pin 90, in which golfer 14 can strike it.

Post 80 defines two section ejector pin passage 82 and a ball return passage 84. Passage 82 defines a passage 86, and a narrower, connecting passage 88. Tee pin 90 acts as the golf "tee" from which golfer 14 putts ball 18. Tee pin 90 is located within passages 86 and 88, and is used to raise ball 18 from post 80 through hole 29 in green 24, and retain ball 18 in its initial position until it is putted by golfer 14. Pin 90 defines a base or button 92 and tee 94. The end 98 of tee 94 defines a depression 96 that cradles ball 18 to stabilize it as it is raised from post 80 and waits in its initial position to be putted. Pin 90 is free to slide within passage 82 upwardly until upper surface 73 of base 92 contacts upper end 132 of passage 86. The downward travel of tee pin 90 is limited by wire 112 as it rests on upper surface 52 of plate 38.

Figure 14B:
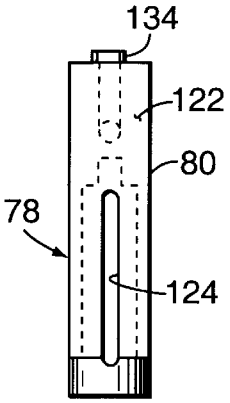
FIG. 14B is an opposite end view of the post shown in FIG. 14.
Figure 14A:
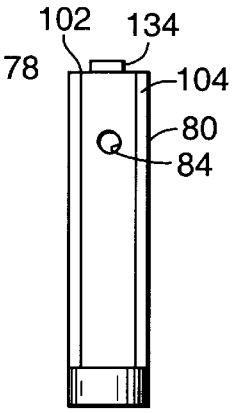
FIG. 14A is an end view of the post shown in FIG. 14.
Figure 14:
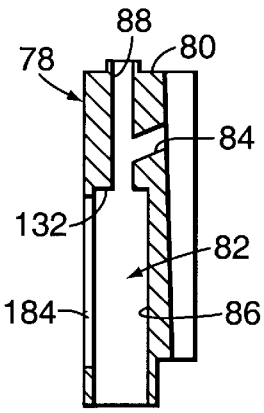
FIG. 14 is a sectional view of the ejector post of the ball return assembly of the display mechanism shown in FIG. 2.
Figure 17:
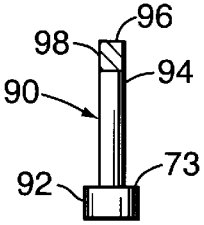
FIG. 17 is a side view in partial section of the tee pin of the ball return assembly shown in FIG. 15
Figure 7:
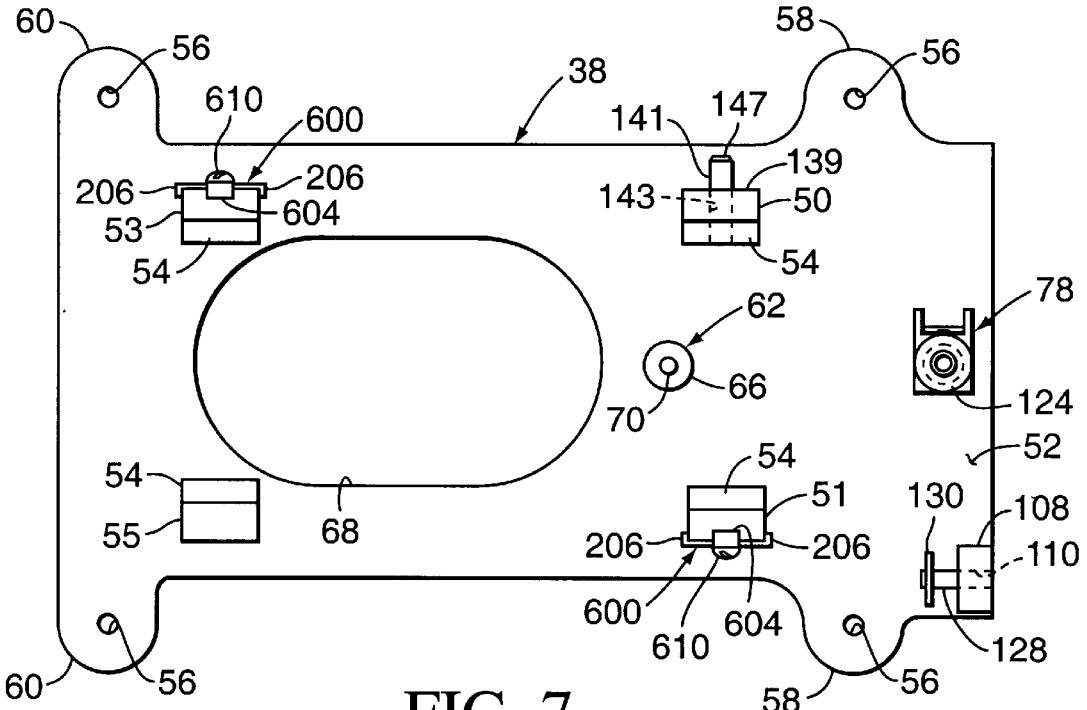
FIG. 7 is a top view of the mechanism base of the display mechanism shown in FIG. 2.
Figure 8:
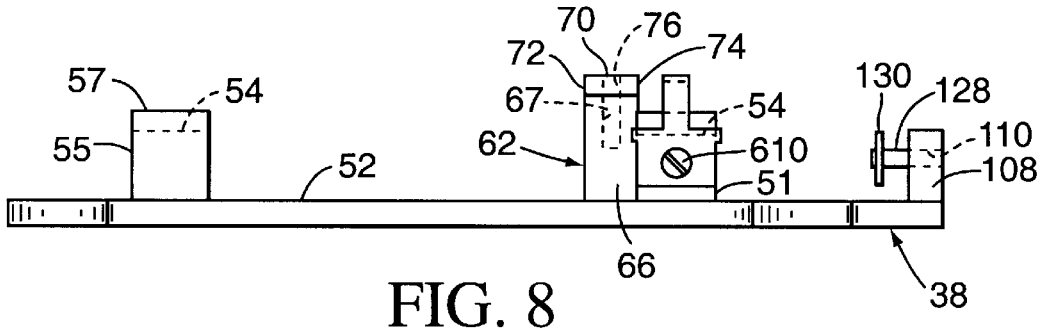
FIG. 8 is a side view of the mechanism base shown in FIG. 7.
Figure 9A:
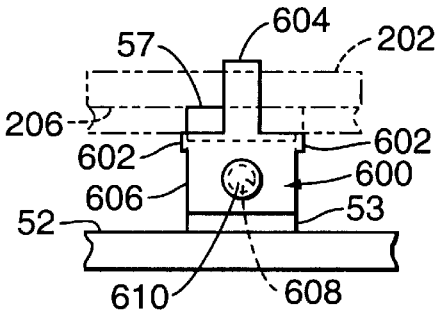
FIG. 9A is a front elevational view of the mounting post shown in FIG. 9.
Figure 9:
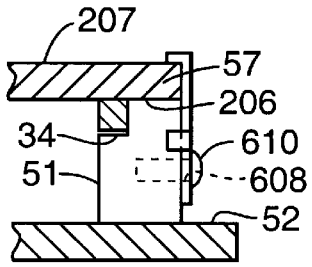
FIG. 9 is a sectional side view showing one of the mounting posts of the display mechanism shown if FIG. 2.
Figure 10:
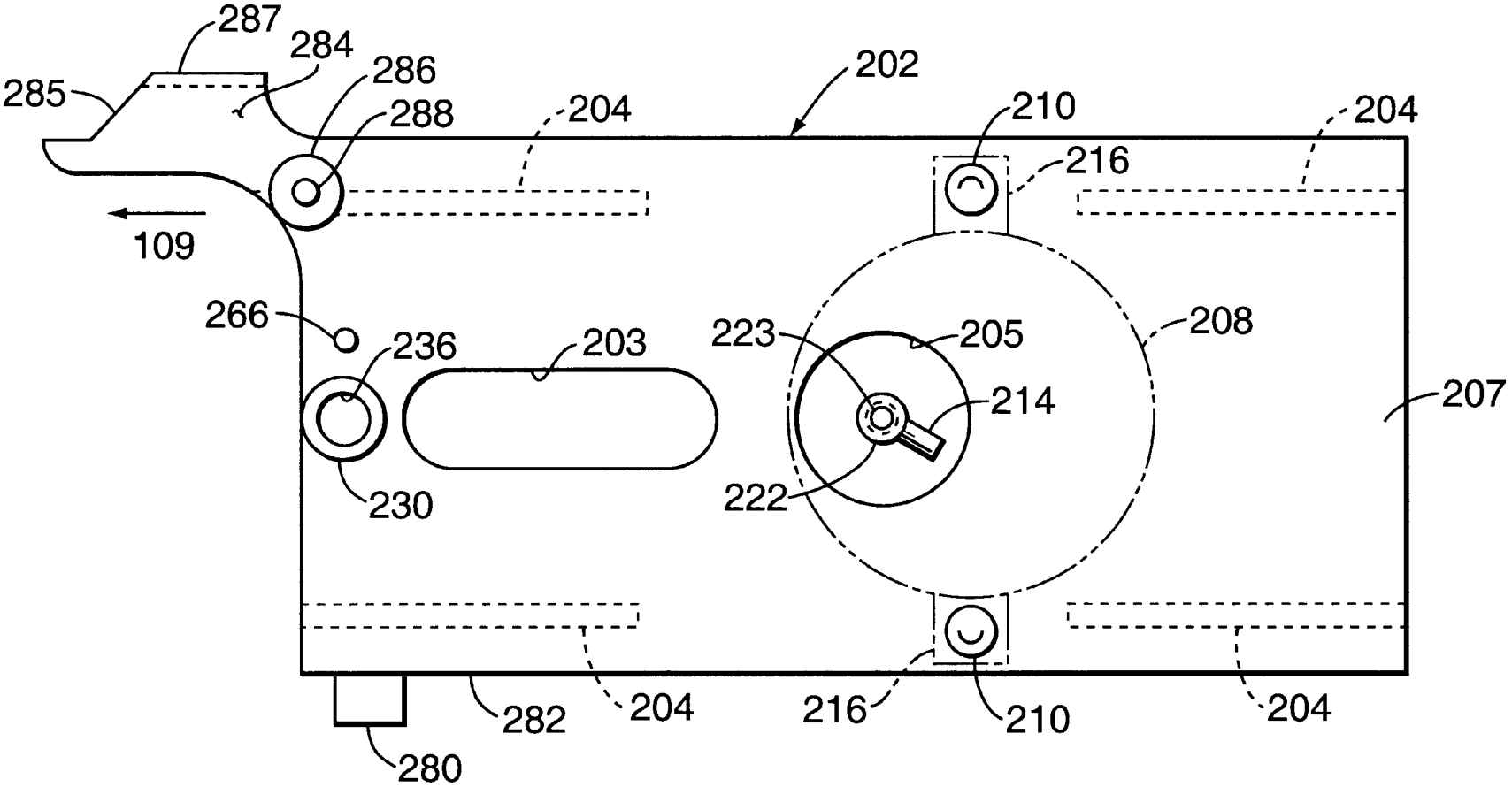
FIG. 10 is a top view of the shuttle plate of the display mechanism shown in FIG. 2.

Ball return passage 84 permits ball 18 to travel from ball return arm 356 to compartment 88 of passage 82, where it comes to rest in depression 96 of tee 94 when pin 90 is in its lower position, where end 98 of pin 90 is below the outlet of passage 84 as shown in FIG. 14. Passage 84 is inclined at an angle of, preferably, 25 degrees to the horizontal, where it is aligned with passage 372 formed in ball return arm 356, when ball return arm 356 is raised by lever 137 to the position in which it delivers ball 18 to assembly 78. Post 80 also defines a pair of guides 102 and 104 that form a way 100, which receives end 374 of ball return arm 356 to register the position of ball return arm 356 with post 80. The depth of way 100 decreases from the top to the bottom of post 80 to accommodate the arc motion of end 374 of ball return arm 356. Side 122 of post 80 defines a slot 124, which communicates with passage 86. Post 80 also defines a lip 134 of a diameter that is slightly less than the diameter of hole 29, which allows registration of the outlet of passage 88 of post 80 with green 24 and hole 29 to position post 80 properly, and allow end 98 of pin 90 and ball 18 to pass through green 24 to the initial position of ball 18.

Tee pin actuator 114 raises tee pin 90 within passage 82 to raise ball 18 through hole 29 after ball 18 is seated in depression 96, and subsequently allows tee pin 90 to be lowered to its position in which ball 18 can be returned to depression 96. Actuator 114 is mounted to a mount 108 defined by plate 38. Mount 108 extends upwardly from upper surface 52 of plate 38, and defines a mounting hole 110. A 0.021 inch diameter wire 112 is force fit within a passage 118 formed in tee pin actuator 114. End 120 of wire 112 is inserted through slot 124 formed in post 80, and is located between the bottom surface 95 of button 92 and upper surface 52 of plate 38. A pin 128 is press fit within hole 110 of mount 108. Tee pin actuator 114 defines a hole 126 through which pin 128 is inserted to mount tee pin actuator 114 for rotation onto mount 108. A snap ring 130 is mounted onto the end of pin 128 to ensure that tee pin actuator 114 does not slip off pin 128. Rotation of tee pin actuator 114 causes wire 112 to travel vertically within slot 124 to raise and lower pin 90. The downward travel of pin 90 is limited by wire 112 as it rests on the upper surface 52 of plate 38. The upward travel of pin 90 is limited by upper end 132 of passage 86 of passage 82, against which the upper surface of button 92 of pin 90 abuts as it travels upwardly. The dimensions of pin 90 and passage 82 are chosen to ensure that ball 18 is positioned properly slightly above green 24 when it reaches its initial position. Tee pin actuator 114 defines a cam 136 that includes an extension 138 that is contacted by extension 284 defined by shuttle plate 202 it moves in the direction indicated by arrow 109. Accordingly, as slide plate 202 moves in the direction indicated by arrow 109, extension 284 contacts extension 138, actuator 114 is rotated on pin 128, and wire 112 raises pin 90 and ball 18. When the upper surface 73 of base 92 of pin 90 contacts upper edge 132 of passage 86, end 98 of pin 94 and ball 18 have emerged from within base 22 through hole 29, and ball 18 rests in its initial position just above green 24.

A lever 137 is rotatably mounted to side 139 of bearing post 50. Extension 280 formed on shuttle plate 202 engages surface 149 of lever 137 causing its arm 147 to rotate and raise and lower end 374 of ball return arm 356. A pin 141 is press fit in hole 143 formed through mount 50. Lever 137 defines a passage 145 through which pin 141 can pass. Lever 137 is mounted to side 139 of mount 50 by passing pin 141 through passage 145, and securing a snap ring 147 onto the end of pin 141 to prevent lever 137 from slipping off pin 141.

Golfer 14 is mounted to shuttle plate 202, which moves linearly relative to mechanism base 38 and base 22, toward and away from tee pin 90 and hole 29. Golfer 14 includes a golfer FIG. 15, and a mounting post 270 that is mounted to the feet of golfer FIG. 15 and extends downwardly therefrom. Mounting post 270 includes an index pin 420 that is used to orient golfer 14 properly. Shaft 270 also defines a tapered section 274 at end 275 to permit easy engagement with spring clip 244. Plate 202 defines or includes four elongated slides 204 on its undersurface 206, each of which is positioned to engage and slide along a notch 54 of a bearing post 50, 51, 53 or 55 on base 38. An electric motor 208, rated at 129 Volts, 60 Hertz, 3.0 Watts, 2.5 r.p.m., counterclockwise direction of rotation, is mounted to undersurface 206 of shuttle plate 202 with a pair of eyelet rivets 210, which extend through holes 212 formed in shuttle plate 202 and holes 218 formed in motor brackets 216. Eyelets 210 are flared to secure motor 208 to shuttle plate 202. Motor 208 provides the motion for both the linear and rotational elements of the movement of golfer 14.

Shuttle plate 202 defines bushing 230, by which a golfer actuator 232 is mounted to plate 202. Golfer 14 is mounted to actuator 232, which is rotated by cam 292. Oscillation of actuator 232 causes corresponding oscillation of golfer 14, thus providing the oscillatory element of motion to golfer 14. Actuator 232 defines an actuator arm 240, a shaft 238, a spacer 234 and a slotted hub 241. Bushing 230 defines a passage 236 that is sized to receive shaft 238 to mount actuator 232 to plate 202. Cam 292 engages arm 240 and oscillates it as cam 292 is rotated by motor 208.

End 246 of shaft 238 defines a notch 242 that is used with spring clip 244 to secure shaft 238 in place within passage 236. To secure actuator 232 in place, shaft 238 is passed through passage 236 until end 246 and notch 242 clear bottom end 231 of bushing 230, and are exposed. End 248 of clip leg 252 and end 250 of clip leg 254 of clip 244 are forced against shaft 238 until they separate and admit shaft 238 between them. Shaft is oriented to allow leg 254 to be located within notch 242. Clip 244 is pushed until shaft 238 is cradled within curved section 256 of leg 252. Clip 244 prevents shaft 238 from being withdrawn from bushing 230. The thickness of 230 is so chosen that the distance between spacer 234 and notch 242 is generally equal to the length of bushing 230, to minimize the longitudinal movement of shaft 238 within passage 236.

A spring 258 defines a coiled section 260 that is disposed around spacer 234. Spring 258 defines a catch section 262 that is adapted to cradle actuator arm 240. Spring 258 also defines an anchor section 264 that is adapted to cradle a pin 266 formed on surface 207 of plate 202 when actuator 232 is mounted in place on plate 202. Accordingly, when actuator 232 is rotated away from its rest position in a clockwise direction, spring 258 exerts a biasing force against actuator 232 in the counterclockwise direction.

Actuator 232 defines a central passage 268 through shaft 238, spacer 234, arm 240 and hub 241. Passage 268 is sized to receive shaft 270 of golfer 14, by which golfer 14 is mounted to animation mechanism 12. Hub 241 defines a radial slot 408 that is sized to engage post pin 420. To mount golfer 14 to mechanism 12, shaft 270 is inserted in passage 268 until it engages leg 254 of spring 244. Golfer 14 then is rotated until side pin 420 in shaft 270 aligns with slot 408 in hub 241. A slight downward axial motion on shaft 270 causes pin 420 to locate in slot 408. Golfer 14 is then in the proper orientation for operation of display 10. In this position, leg 254 of spring 244 bears radially against shaft 270 above tapered section 274 to reduce the chance of longitudinal movement of shaft 270, which would cause pin 420 on shaft 270 to disengage from slot 408 in hub 241.

Plate 202 defines a tab 280 that extends from side 282 of plate 202. Plate 202 also defines an elongated opening 203 which allows post 66 and bearing 74 to extend through plate 202. Slide plate 202 also defines a circular opening 205 that allows shaft 222 of motor 208 and the hub of cam 292 to extend through plate 202. Tab 280 is adapted to engage surface 149 of lever 137 to operate lever 137. Plate 202 also defines an extension 284 that is sized and shaped to engage extension 138 of tee pin actuator 114 to operate actuator 114.

A post 286 is molded to upper surface 207 of plate 202. A pivot pin 288 is press fit into a hole drilled into the end 290 of post 286. End 335 of magnet arm 334 is mounted on pin 288 for rotation.

Plate 202 is mounted to mechanism base 38 using a pair of retainer clips 600. Each clip 600 defines a pair of side lugs 602 and a top lug 604, a body 606 and a mounting hole 608. Plate 202 is mounted to base 38 by aligning plate 38 and plate 202 so that post 66 and bearing 74 extend through opening 203 formed in plate 202, and locating slides 204 within notches 54 formed in mountings 50, 51, 53, and 55. Then, a retainer clip is installed on each of mountings 53 and 51, by placing top lug 604 adjacent the upper surface 207 of slide plate 202 and side lugs 602 on the sides of mountings 51 and 53. A screw 610 is threaded through opening 608 and into pre-drilled and tapped holes formed in mountings 51 and 53. The pre-drilled holes in mountings 51 and 53, and the configuration of clips 600 ensure that there is sufficient clearance between the top surface 207 of slide plate 202 and the undersurfaces of top lugs 604 of retainer clips 600 to permit free movement of slide plate 202 with respect to plate 38. Slide plate 202 can slide linearly with respect to plate 38. Slides 204 limit lateral movement of plate 202 with respect to plate 38, there being clearance between the bottom surfaces of slides 204 and the horizontal surfaces of notches 54. The bearing surface exists between the upper surfaces 57 of mountings 50, 51, 53 and 55, and under surface 206 of slide plate 202.

Figure 11:
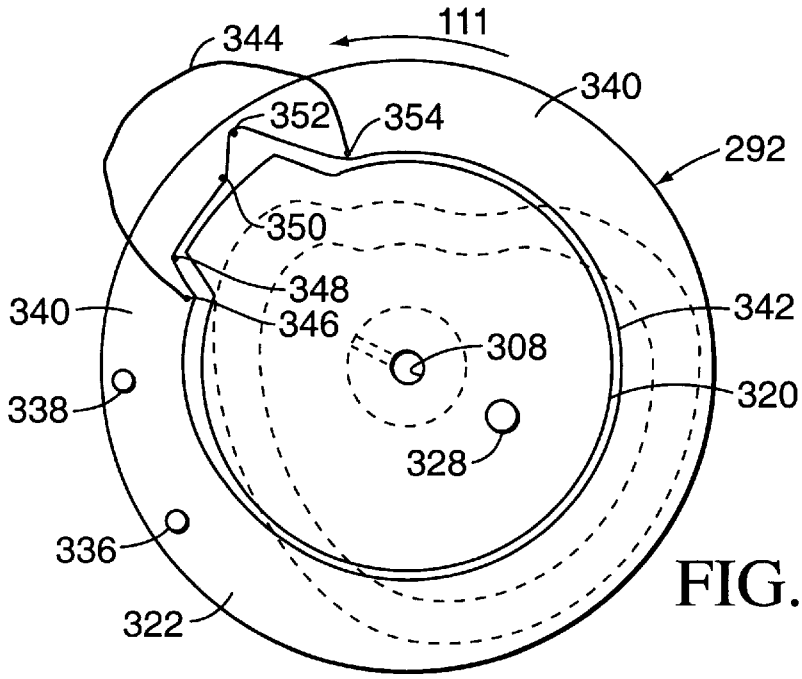
FIG. 11 is a top view of the cam member of the display mechanism shown in FIG. 2.
Figure 12:
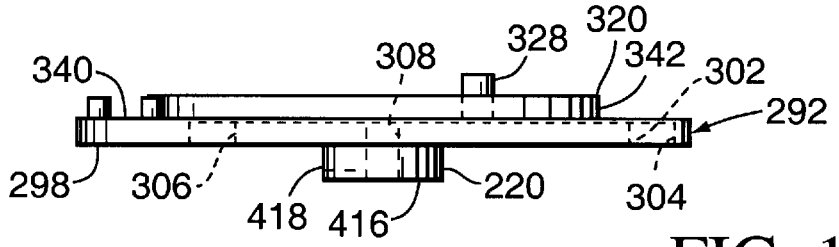
FIG. 12 is a side view of the cam member shown in FIG. 11.
Figure 13:
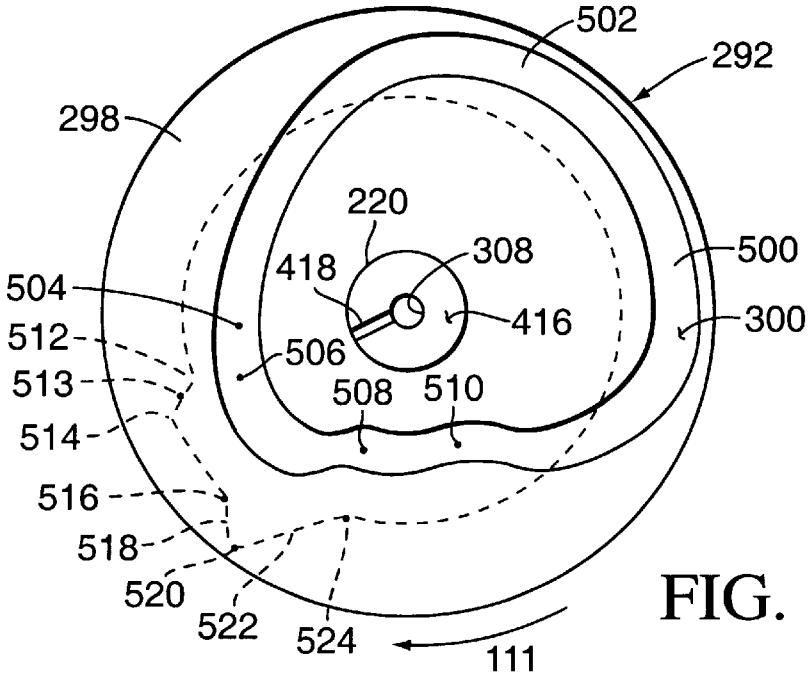
FIG. 13 is a bottom view of the cam member shown in FIG. 11.
Figure 19:
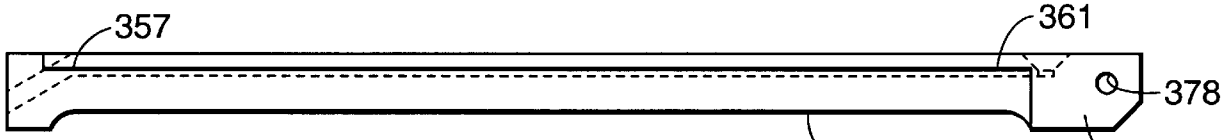
FIG. 19 is a side view of the ball return arm of the display mechanism shown in FIG. 2.
Figure 19A:
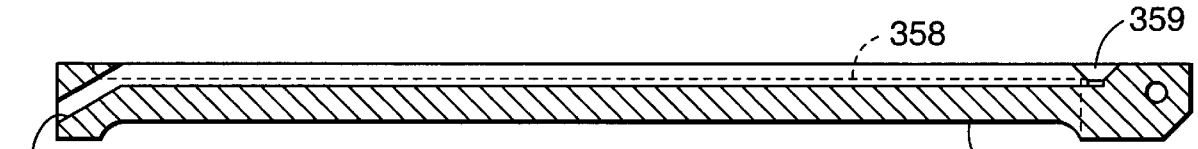
FIG. 19A is a side sectional view of the ball return arm shown in FIG. 19.
Figure 19B:
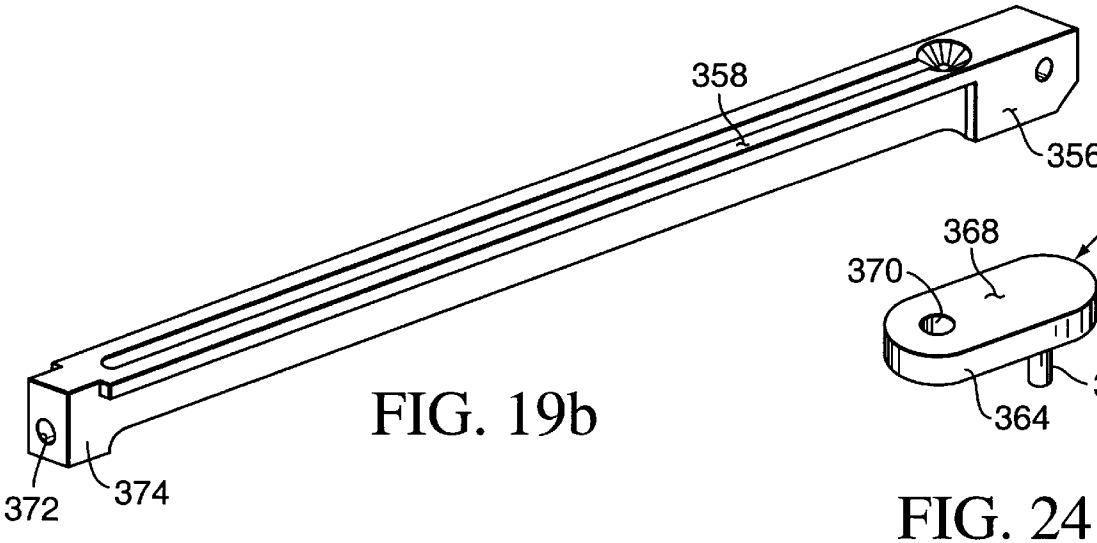
FIG. 19B is an orthographic view of the ball return arm shown in FIG. 19.
Figure 24:
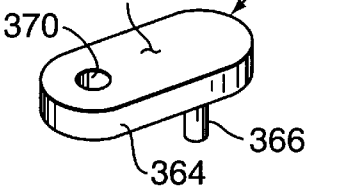
FIG. 24 is an orthographic view of the pivot post for the ball return arm shown in FIG. 19.
Figure 25:
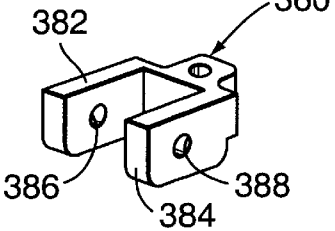
FIG. 25 is an orthographic view of the swivel link for the ball return arm shown in FIG. 19.

A cam 292 is mounted to shaft 222 of motor 208 with a screw 294, which is threaded into a tapped hole 223 in the end of motor shaft 222. Both motor shaft 222 and, accordingly, cam 292, are rotated by motor 208 in the direction indicated by arrow 111 shown in FIGS. 5, 11 and 13. A hub 220 is molded to undersurface 298 of cam 292 and contains a through passage 308. The bottom surface 416 of hub 220 has a diametral slot 418, which engages with a radial pin 214 located at the base of motor shaft 222. The radial pin 214 transmits the torque from the motor shaft 222 to hub 220 of the cam assembly 292. Cam assembly 292 is secured to motor shaft 222 with a screw 294 which is threaded into the end of motor shaft 222. Accordingly, cam 292 rotates with shaft 222 as shaft 222 is rotated by motor 208.

Undersurface 298 of cam 292 defines an irregularly shaped cam track 300 with a floor 302 that lies in the plane of cam 292 and side walls 304 and 306, that are orthogonal to floor 302. When cam 292 is mounted to motor shaft 222, roller cam bearing 74 is confined by floor 302 and walls 304 and 306, and, accordingly, rides in cam track 300. The distance between cam track 300 and the center of rotation of cam 292 varies along track 300. Accordingly, as cam 292 is rotated by motor 208, the distance between cam bearing 74 and the center of rotation of cam 292 must change, and, therefore, cam bearing 74 and cam 292 move radially with respect to each other as roller cam bearing 74 moves through sections of cam track 300 in which the distance between track 300 and the center of rotation of cam 292 changes. Since the position of mechanism base 38 is fixed with respect to base 22, it is the cam, and plate 202 and golfer 14, that is forced to move rather than mechanism base 38. It is this arrangement that gives the linear component of motion to golfer 14, allowing golfer 14 to approach and move away from tee pin 90.

Figure 16:
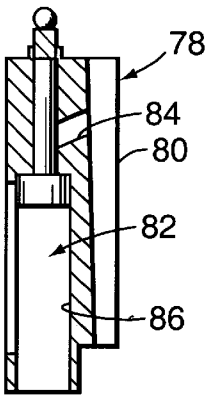
FIG. 16 is a side sectional view of the assembly shown in FIG. 15, with the tee pin in its fully raised position, in which the golf ball is in its initial position above the ejector post.

Cam 292 defines a raised cam platform 320 and a cam base 322. A drive pin 328 is formed in the upper surface of cam platform 320. Pin 328 cooperates with magnet arm 334 as cam 292 rotates to cause magnet arm 334 to move swan FIG. 16 in a predetermined, irregular, but repetitive, path on simulated pond 20 defined by base 22.

Cam base 322 defines a pair of cam posts 336 and 338, which extend from upper surface 340 of cam base 322 in a direction that is perpendicular to the plane of cam base 322. As cam 292 is rotated by motor 208, posts 336 and 338 deflect golfer actuator 232, causing it to rotate until post 336 or 338 passes arm 240 and spring 258 returns actuator 232 to its initial position against side 342 of cam platform 320. As post 336 engages actuator arm 240 and deflects it away from platform side 342, therefore, golfer 14 rotates "backward" to prepare to execute the first practice stroke, and as it passes by arm 240, spring 258 returns arm 240 to platform side 342 to cause golfer 14 to execute the first practice stroke. Similarly, post 338 engages actuator arm 240 to cause golfer 14 to prepare to execute the second practice stroke.

Cam platform 320 is circular in shape with the exception of section 344. As section 344 engages and moves past actuator arm 240, golfer 14 rotates quickly away from and then toward tee pin 90 to execute a "backswing" and putt ball 18 with club 17. As arm 240 travels from point 346 to point 348 in section 344, golfer 14 rotates slowly in the clockwise direction to move club 17 slightly behind the tee pin 90 to allow golfer 14 to approach tee pin 90 without disturbing ball 18 on pin 90 with club 17. When arm 240 reaches point 348, golfer 14 stops rotating. As arm 240 travels from point 348 to point 350 of section 344, golfer 14 approaches and addresses ball 18 to prepare to make the putt. From point 350 to point 352, arm 240, and, therefore, golfer 14, is rotated quickly in the clockwise direction, to simulate golfer 14 executing a "backswing." As arm 240 travels from point 352 to 354, spring 258 rotates arm 240 quickly in a counterclockwise direction to side 342 of cam platform 320, and, correspondingly, golfer 14 executes the putt and strikes ball 18 with club 17. As arm 240 travels from point 354 to point 346, arm 240, and golfer 14, are rotationally stationary.

Ball return arm 356 defines a channel 358 along which ball 18 returns to ejector post 80 for return to tee pin 90. Arm 356 is secured to undersurface 40 of base 22 using a swivel link 360 and a pivot post 362. Pivot post 362 defines a base 364 and a post 366, and a ball return hole 370. Pivot post 362 is mounted to undersurface 40 of base 22 by gluing surface 368 of base 364 to undersurface 40 in such a position that ball return hole 370 is aligned with hole 28 in green 24 to permit golf ball 18 to fall through holes 28 and 370, and into trough 358. Ball return arm 356 defines a ball delivery outlet 372, which communicates with trough 358, to permit ball 18 to travel down trough 358 and into passage 372, where it is delivered to post 80. The angle at which the longitudinal axis of outlet 372 is formed prevents ball 18 from returning to trough 358 when ball return arm 356 is raised by crank 137 to the limit of its upward travel. this reverse action of ball 18 would prevent the delivery of ball 18 to post 80.

End 376 of ball return arm 356 defines a hole 378, which is adapted to receive a round head rivet 380. To mount ball return arm 356 to swivel link 360, end 376 is located between mounting flanges 382 and 384 defined by swivel link 360, and rivet 380 is inserted through hole 386 formed in flange 382, hole 378 formed in end 376 of return arm 356, and through hole 388 formed in flange 384. A grip ring 390 is snapped around the exposed end of rivet 380 to hold it in place. Accordingly, ball return arm 356 is free to rotate about rivet 380.

Magnet arm 334 defines an elongated mounting section 392 that forms a hole 394, and a magnet section 396, which forms an elongated slot 398, and in recessed surface 402 of which a flat, circular permanent magnet 400 is secured at end 404. Pin 288 fits within hole 394, and pin 328, which is formed on cam 292, fits within slot 398. Accordingly, magnet 400 traces an irregular course as cam 292 rotates. A magnet (not shown) is glued to the bottom of swan 16, in such an orientation that opposite poles of this magnet and magnet 400 can attract each other. To ensure proper orientation of swan 16 on pond 20, the orientation of the north-south poles of the magnetic field of magnet 400 is located on the vertical or central axis of magnet 400, while the orientation of the north-south poles of the magnetic field of the magnet on swan 16 is located on a diametral axis of the magnet, which is perpendicular to the orientation of the north-south poles of magnet 400. When magnet arm 334 is properly mounted, magnet 400 lies just below the plastic sheet that forms the surface of pond 20. Accordingly, swan 16 can be magnetically coupled to magnet 400 by placing swan 16 on pond 20 near or over magnet 400 to permit the two magnets to attract and become engaged. Accordingly, swan 16 traces the path traced by magnet 400 as cam 292 rotates, to "swim" on pond 20.

Operation of display 10 will be described with display 10 at the beginning of an animation cycle and, therefore, golfer 14 and shuttle plate 202 in their initial positions, in which golfer 14 and edge 201 of plate 202 are at their maximum distances from tee pin 90 and hole 29. When motor 208 is energized, motor shaft 222 begins to turn, thereby rotating cam 292, causing roller bearing to begin traveling along track 300, and causing actuator 232 to begin following cam side wall 342. As bearing 74 travels through sections of cam track 300 in which the distance between track 300 and the center of rotation of cam 292 changes, shuttle plate 202 must move toward or away from hole 29, depending on whether the distance decreases or increases, thus moving golfer toward or away from hole 29. As actuator 232 encounters sections of cam side 342 in which the distance between side 342 and the center of rotation of cam 292 changes, actuator 342 will pivot on its shaft 238 in passage 236, causing golfer 14 to change its angular orientation, to either take a practice swing or actually putt ball 18.

At the beginning of the animation cycle, roller bearing 74 is located at point 500 of cam track 300. Arm 147 of lever 137 is being held in its fully raised position by extension 280 of plate 202, which supports end 374 of arm 356 in its fully raised position, in which passage 372 of arm 356 is aligned with passage 84. Ball 18 is resting within depression 96 in end 98 of tee pin 90. Tee pin 90 is in its lowest position, in which end 98 of pin 90 is just below passage 84. Golfer 14 is facing hole 29. As display 10 begins to execute the animation cycle, bearing 74 begins to move from point 500 of track 300 to point 502, during which period golfer 14 is stationary, since the distance between roller 74 and the center of rotation of cam 292 remains constant, and the distance between side 342 of cam 292, and, thus, between actuator 232, and the center of rotation of cam 292 remains constant. As cam 292 continues to rotate, bearing 74 passes point 502, where the distance between roller 74 and the center of rotation of cam 292 begins to decrease, which causes plate 202 and golfer 14 to move toward hole 29. As golfer 14 begins to move toward hole 29, extension 280 begins to move away from lever 137, which allows the weight of arm 356 to rotate lever 137 downwardly, thus lowering end 374 of arm 356 to the upper surface 52 of mechanism base 38, in which position arm 356 can deliver ball 18 to assembly 78. At the same time, extension 284 of plate 202 begins to contact surface 138 of actuator 114, thus causing wire 112 to begin rotating upwardly and begin raising tee pin 90 and ball 18. Thus, as golfer 14 begins to move toward hole 29, end 374 of arm 356 begins to fall, and ball 18 begins to rise toward the position in which it can be putted by golf club 17.

At point 504, the distance between bearing 74 and the center of rotation of cam 292 again becomes constant, which stops the movement of golfer 14 toward hole 29 at a point where golfer 14 will take two practice swings. By the time golfer 14 has reached this practice position, end 374 of arm 356 has reached its lower limit of travel, and tee pin 90 has reached its upper limit of travel, in which ball 18 has emerged through hole 29, and is in the position in which it may be putted.

As bearing 74 travels from point 504 to point 506, golfer 14 remains at the position in which two practice strokes are taken, since bearing 74 remains at a constant distance from the center of rotation of cam 292. During this period, actuator 232 encounters pins 336 and 338, which cause it to oscillate through a limited arc twice. Each oscillation involves movement of actuator 232, and golfer 14, through a limited arc in a clockwise direction, to cause golfer 14 to execute a backswing, followed by movement in the counterclockwise direction return actuator 232 and golfer 14 to their original positions, thus causing golfer 14 to execute the practice swing.

As bearing 74 approaches point 506, actuator 232 becomes disengaged from pin 338, and rotates in a counterclockwise direction to contact sloped section 512 of 342 of cam 292. As actuator 232 travels along section 512, actuator 232 is rotated through a small arc in the clockwise direction, thus rotating golfer 14 through the same small arc in the clockwise direction. When actuator 232 reaches point 513, which represents the dividing point between sloped section 512 and section 514, golf club 17 of golfer 14 is in a position in which it will not disturb ball 18 when golfer 14 is advanced to the position in which golfer 14 will putt ball 18.

As actuator 232 reaches point 513, bearing 74 reaches point 506. As bearing 74 passes point 506 and travels from point 506 to point 508 in track 300, the diminishing distance between bearing 74 and the center of rotation of cam 292 causes plate 202 and golfer 14 again to move toward hole 29. When bearing 74 reaches point 508, golfer 14 is in position to putt ball 14. Between point 508 and 510 the distance between track 300 and the center of rotation of cam 292 remains constant. Accordingly, as bearing 74 travels from point 508 to 510, plate 202 and golfer 14 do not move toward or away from hole 29, and golfer 14 remains at the position in which golfer 14 can putt ball 18.

During the time in which bearing 74 travels from point 508 to 510, actuator 232 reaches point 516 of wall 342, and begins traveling up sloped section 518, which causes actuator 232 and golfer 14 to move through an arc in the clockwise direction to execute a backswing preparatory to putting ball 18. When actuator 232 reaches point 520, golfer 14 has completed the backswing. Actuator 232 then begins to traverse sloped section 522 of wall 342, which causes actuator 232 and golfer 14 to begin returning to their original radial positions and cause golfer 14 to begin executing the actual putt. When actuator 232 reaches point 524, the putt has been completed, and golf club 17 has stroked ball 18 from tee pin 90 into trough 36, where it begins rolling toward hole 28. As actuator 232 travels from point 524 to its engagement with pin 336, golfer 14 is rotationally stationary.

At point 510, the distance between track 300 and the center of rotation of cam 292 begins to increase, which moves plate 202 and golfer 14 away from hole 29. When bearing 74 reaches point 500, plate 202 and golfer 14 stop moving away from hole 29, and the animation cycle begins again.

Prior to the time at which bearing 74 reaches point 500, surface 138 of actuator 114 slides along surface 287 of extension 284, which is moving away from hole 29 with plate 202, and begins to slide along surface 285 of actuator 114. As surface 138 slides along surface 285, actuator 114 begins to rotate downwardly, thereby lowering wire 112 which, in turn, allows tee pin 90 to be lowered within assembly 78. Wire 112 and tee pin 90 reach mechanism base just as golfer 14 reaches its initial position.

After golf club 17 has stroked ball 18 into trough 36, ball 18 rolls along trough 36 and into hole 28. After passing through hole 28, ball 18 passes through hole 370 of pivot post 362, and drops into depression 359 in arm 356. Ball 18 then rolls down channel 358 until it reaches the outlet of passage 372, where it awaits delivery to ball return assembly 78. Generally, ball 18 reaches passage 372 before bearing 74 reaches point 510 and golfer 14 begins to move away from hole 29, and at a time when end 374 of arm 356 is still fully lowered.

After bearing 74 passes point 510, but before it reaches point 500, end 374 of arm 356 is raised to its fully raised position as extension 280 moves away from hole 29 with plate 202 and engages and rotates lever 137. As extension 280 engages lever 137, arm 147 is rotated upwardly, raising arm 356. When arm 356 is in its fully raised position, passages 372 and 84 are aligned, ball 18 rolls from passage 372 into and along passage 84, and onto depression 96 of lowered tee pin 90, and ball 18 is in its initial position. Ball 18 does not roll back up passage 372 into channel 358 because end 357 of channel 358 is always lower than end 361 of channel 358, even when arm 356 is in its fully raised position.

This animation cycle is repeated as long as display 10 is operating, unless ball 18 becomes dislodged somewhere during the cycle.

What is claimed is:

1. A mechanism for providing motion to an object associated with an animated display, said mechanism comprising:

a support;

a slide mounted to said support for movement relative thereto, with which the object is associated;

a source of motion associated with said slide, movement of said slide causing movement of said source of motion and the object; and a translator that converts the motion produced by said motion source to movement of said slide.

2. The mechanism recited by claim 1 wherein said translator converts the motion produced by said motion source to a second type of motion.

3. The mechanism recited by claim 2 wherein said second type of motion is oscillatory motion through an arc.

4. The mechanism recited by claim 1 wherein said motion source includes a drive member that is rotated by said motion source, and said translator is a cam that is mounted to said drive member.

5. The mechanism recited by claim 4 wherein said drive member is a drive shaft, and said cam defines a track.

6. The mechanism recited by claim 5 further comprising a track post mounted to said support, said track post including a bearing that is adapted to ride along said cam track as said motion source and said drive shaft rotate said cam, the distance between said cam track at the location of said track post and the center of rotation of said cam determining the position of said slide relative to said support, the shape of the path defined by said track determining the movement of said slide.

7. The mechanism recited by claim 6 wherein said track defines a path with at least two stationary sections, the distance between each of said stationary sections and said center of rotation of said cam remaining substantially constant throughout said stationary path section, said slide remaining stationary as said post travels along each said stationary section, and at least one motive section, the distance between said motive section and said center of rotation of said cam changing along said motive section, said slide moving relative to said support as said track post travels along said motive section, said slide moving and stopping as said post moves along a motive section and then a stationary section.

8. The mechanism recited by claim 7 wherein said track path includes a start stationary section having the greatest distance from the center of rotation of said cam, followed by a practice motive section, the distance of the beginning of said practice motive section from said center of rotation of said cam being the same as that of said start stationary section, the end of said practice motive section being at a lesser distance from the center of rotation of said cam than that of the beginning of said practice motive section, said practice motive section being followed by a practice stationary section at a distance from the center of rotation of said cam that is the same as that of said end of said practice motive section, said practice stationary section being followed by an approach motive section, the distance of the beginning of said approach motive section from the center of rotation of said cam being the same as that of said practice stationary section, the distance between the end of said approach motive section and the center of rotation of said cam being less than that of said beginning of said approach motive section, said approach motive section being followed by a ready stationary section at a distance from the center of rotation of said cam as that of said end of said approach motive section, said ready stationary section being followed by a finish motive section, the distance between the beginning of said finish motive section and the center of rotation of said cam being the same as that of said ready stationary section, the distance between the end of said finish motive section and the center of rotation of said cam being the same as that of said start stationary section, said finish motive section being followed by said start stationary section.

9. The mechanism recited by claim 6 wherein:

said cam defines a cam surface;

said mechanism includes an actuator that is mounted to said slide for rotational movement;

a biasing member for forcing said actuator against said cam surface; and said cam surface defining a cam member, said actuator rotating as said cam rotates and said actuator engages and rides over said cam member.

10. The mechanism recited by claim 9 further comprising a second said cam member that provides less rotation to said actuator as said actuator engages and rides over said second cam member as said cam rotates.

11. The mechanism recited by claim 10 further comprising a ball return assembly that is operated using the movement produced by said source of motion.

12. The mechanism recited by claim 11 wherein said ball return assembly includes a return channel unit defining a ball deposit end and a ball delivery end connected by a channel, said return channel unit being pivotable between a return position in which said ball deposit end is higher than said ball delivery end and a ball will travel from said deposit end to said delivery end along said channel, and a delivery position in which a ball located in said delivery end can be returned to a desired position.

13. The mechanism recited by claim 12 wherein said ball return assembly further includes a ball delivery unit that delivers a ball from said delivery end of said return channel unit to the desired location.

14. The mechanism recited by claim 4 wherein said cam defines a cam member and said mechanism includes an actuator mounted to said slide for rotational movement and a biasing member that biases said actuator toward a starting position, said cam member rotating said actuator away from said starting position as said actuator engages and rides over said cam member, said biasing member forcing said actuator to said starting position when said actuator is not engaged with said cam member.

15. The mechanism recited by claim 1 wherein the object and said source of motion are both mounted to said slide, the distance between the object and said source of motion remaining substantially constant as they are moved by movement of said slide.

16. A mechanism for providing motion to an object associated with an animated display, said mechanism comprising:

a support;

a slide mounted to said support for movement relative thereto;

a source of motion mounted to said slide that includes a drive shaft that is rotated by said motion source;

a cam that defines a track, and that is mounted to said drive member and that converts the motion produced by said motion source to movement of said slide and to a second type of motion as said cam is rotated by said source of motion;

a track post mounted to said support, said track post including a bearing that is adapted to ride along said cam track as said motion source and said drive shaft rotate said cam, the distance between said cam track at the location of said track post and the center of rotation of said cam determining the position of said slide relative to said support, the shape of the path defined by said track determining the movement of said slide;

said track defining a path with at least two stationary sections, the distance between each of said stationary sections and said center of rotation of said cam remaining substantially constant throughout said stationary path section, said slide remaining stationary as said bearing travels along each said stationary section, and at least one motive section, the distance between said motive section and said center of rotation of said cam changing along said motive section, said slide moving relative to said support as said bearing travels along said motive section, said slide moving and stopping as said post moves along a motive section and then a stationary section;

said cam defining a cam surface;

said mechanism includes an actuator that is mounted to said slide for rotational movement;

a biasing member for forcing said actuator against said cam surface;

said cam surface defining a cam member, said actuator rotating as said cam rotates and said actuator engages and rides over said cam member;

a ball return assembly that is operated using the movement produced by said source of motion;

said ball return assembly including a return channel unit defining a ball deposit end and a ball delivery end connected by a channel, said return channel unit being pivotable between a return position in which said ball deposit end is higher than said ball delivery end and a ball will travel from said deposit end to said delivery end along said channel, and a delivery position in which a ball located in said delivery end can be returned to a desired position.

17. An animated display comprising:

a support;

a slide mounted to said support for movement relative thereto;

an object mounted to said slide;

a source of motion mounted to said slide, movement of said slide causing movement of said source of motion and the object; and a translator that converts the motion produced by said motion source to movement of said slide to move said object;

whereby the distance between the object and said source of motion remains substantially constant as the object and said source of motion are moved by said slide.

18. An animated display comprising:

a support;

a slide mounted to said support for movement relative thereto;

an object mounted to said slide;

a source of motion mounted to said slide that includes a drive shaft that is rotated by said motion source;

cam that defines a track, and that is mounted to said drive member and that converts the motion produced by said motion source to movement of said slide and to a second type of motion as said cam is rotated by said source of motion;

a track post mounted to said support, said track post including a bearing that is adapted to ride along said cam track as said motion source and said drive shaft rotate said cam, the distance between said cam track at the location of said track post and the center of rotation of said cam determining the position of said slide relative to said support, the shape of the path defined by said track determining the movement of said slide said track defining a path with at least two stationary sections, the distance between each of said stationary sections and said center of rotation of said cam remaining substantially constant throughout said stationary path section, said slide remaining stationary as said bearing travels along each said stationary section, and at least one motive section, the distance between said motive section and said center of rotation of said cam changing along said motive section, said slide moving relative to said support as said bearing travels along said motive section, said slide moving and stopping as said bearing moves along a motive section and then a stationary section;

whereby rotation of said source of motion causes said object to move and stop with said slide.

19. An animated display in which an animated figure approaches and retreats from a spot and rotates, the display including a single source of motion that causes the figure both to approach and retreat from said spot and to rotate, the distance between said source of motion and the figure remaining substantially constant during operation of the display.

20. An animated golfer display including first means for causing a golfer figure repeatedly to approach and retreat from a fixed spot and second means for causing said golfer to rotate to strike a ball located at said spot with a simulated golf club, the display including a single source of motion that cooperates with said first and second means to cause said golfer to approach and retreat from said spot and to rotate to strike said ball, the distance between said source of motion and the golfer remaining substantially constant during operation of the display.

* * * * *